US006079056A

United States Patent [19]

Fogelberg

[11] Patent Number: 6,079,056

[45] Date of Patent: Jun. 27, 2000

[54] AIR CUSHIONING DEVICE FOR SPORTS USE

[76] Inventor: Val O. Fogelberg, 835 Princeton Ct., Merced, Calif. 95348

[21] Appl. No.: 09/246,713

[22] Filed: Feb. 9, 1999

[51] Int. Cl.[7] ..... A41D 27/26

[52] U.S. Cl. ..... 2/461; 2/44; 2/92; 2/267; 2/DIG. 3; 602/13

[58] Field of Search ..... 2/455, 456, 459, 2/461, 44, 45, 24, 413, 414, 92, 267, DIG. 3; 128/845, 846, 847, 873, 874; 602/13, 17–20

[56] References Cited

U.S. PATENT DOCUMENTS

| | | | |
|---|---|---|---|
| D. 235,699 | 7/1975 | Grant | D2/27 |
| 2,437,054 | 3/1948 | Tatal | 2/268 |
| 3,144,657 | 8/1964 | Groot . | |
| 4,453,271 | 6/1984 | Donzis | 2/DIG. 3 |
| 4,547,905 | 10/1985 | LaPorta, Jr. . | |
| 4,637,074 | 1/1987 | Taheri | 2/DIG. 3 |
| 4,845,785 | 7/1989 | Allen . | |
| 4,870,706 | 10/1989 | Ketcham et al. . | |
| 4,991,230 | 2/1991 | Vacanti . | |
| 5,129,101 | 7/1992 | Douglas . | |
| 5,235,703 | 8/1993 | Maynard | 2/45 |
| 5,390,367 | 2/1995 | Rush, III . | |
| 5,390,368 | 2/1995 | Chang . | |
| 5,546,602 | 8/1996 | Hale . | |
| 5,893,175 | 4/1999 | Cooper | 2/462 |

FOREIGN PATENT DOCUMENTS 42 29 328 A1 3/1994 Germany .

*Primary Examiner*—John J. Calvert
*Assistant Examiner*—Tejash Patel
*Attorney, Agent, or Firm*—Richard C. Litman

[57] ABSTRACT

An air inflated sealed rubber padding cushioning protective device for use in contact sports and worn underneath traditional shoulder pads. The air inflated sealed rubber padding has a smooth, flat surface that changes to a modular configuration when the protective padding is donned; effectively conforming to the contour of the body area covered at creases that constitute flexible joints. The air inflated sealed rubber padding uses the cushioning power of air to displace the force of impact, such as impacts delivered to the shoulder, clavicular, and scapular areas. The protective padding not only prevents injuries, but is also capable of protecting injured players from further injury. Alternatively, the air inflated sealed rubber padding can additionally have a plurality of air filled openings that form an array of air filled pockets having a honeycomb appearance.

8 Claims, 4 Drawing Sheets

AIR CUSHIONING DEVICE FOR SPORTS USE

BACKGROUND OF THE INVENTION

1. Field of the Invention

The present invention relates generally to protective padding equipment and, more particularly, to inflated protective padding gear that can be used in conjunction with protective padding equipment routinely encountered in various contact sports.

2. Description of the Related Art

Contact sports such as football or hockey involve repeated high impact collisions between the participants with the athletes flinging their bodies around with reckless abandon. These high impact collisions quickly take their toll on the athlete's body. Broken and dislocated bones are a common occurrence. The athletes who participate in these contact sports wear protective gear which reduces the number and severity of contact injuries; however, even with the conventional protective gear far too many serious injuries still occur.

These high impact collisions involve the transfer and dissipation of a significant amount of momentum and energy. The energy of the impacts routinely cause broken and dislocated bones especially in the upper thoracic region of the body. Dislocated shoulders and broken arms are common contact sports injuries. These injuries result in a lot of pain and suffering and the athlete is forced to be inactive for a prolonged period of time. Even with all these drawbacks, contact sports are immensely popular and enjoyed by millions of people around the world.

The primary protective gear generally used in contact sports to protect the shoulder, clavicular, and scapular areas of the torso are shoulder pads which are used to absorb a portion of the impact from a collision. These high impact collisions between athletes impart a significant shock to the body and are capable of significant trauma to the body resulting in serious bodily injury, for example, a dislocated shoulder, a broken collar bone (clavicle), or a broken shoulder blade (scapula). For protective gear to do an effective job in protecting an athlete or any contact sport participant, the protective gear must absorb and dissipate a significant portion of the energy of impact; that is, the piece of protective gear must be an excellent shock absorber.

The protective gear must be capable of absorbing concentrated, highly focused energy and rapidly and uniformly dissipate that energy so that the energy does not break bones, tear tendons and ligaments, or dislocate joints. The energy of these collisions is concentrated and highly focused because in general, a specific part of one athlete's body strikes a specific part of the other athlete's body; therefore, the kinetic energy imparted by the impact is both concentrated and focused. Conventionally used protective padding is inadequate in providing the shock absorbing capacity required to prevent serious bodily harm.

Conventional shoulder pads are simply not constructed to adequately absorb the shock incurred by the body when these high impact collisions occur. Shoulder pads are constructed not only to absorb shock, but to function as body armor as well, therefore, a significant portion of a shoulder pad is rigid and incapable of absorbing shock. To minimize the number of contact injuries and to significantly reduce the severity of contact injuries, protective gear must be capable of effectively and efficiently absorbing and dissipating the impact forces of the collisions.

The prior art describes a variety of protective gear used to protect participants of contact sports from physical injury; however, none of the protective gear of the prior art provides the broad protection against injury and the high shock-absorbing capability as does the protective gear of the present invention. Accessory pads adapted for use on the exterior portions of football shoulder pads is described in U.S. Pat. No. 3,144,657 issued on Aug. 18, 1964 to J. K. Groot. The accessory pads are easily and securely attached to the epaulets of football shoulder pads to limit the possible injuries to opposing players by serving as padded outer surfaces. The accessory pads cover the external surfaces of the epaulets without materially increasing the size or weight of the epaulets, or interfering with the free movements of the epaulets during use.

A hinged shoulder pad and the method of making the pad is described in U.S. Pat. No. 4,845,785 issued on Jul. 11, 1989 to F. Allen. The shoulder pad comprises a unitary integral form consisting of a plurality of hingedly connected panels adapted to be interfolded into a pad. The hinged shoulder pad is made of a polyester resin and is made for use in garments such as ladies dresses or suits.

A sports protection garment for use by athletes that provides adjustable upper body protection is described in U.S. Pat. No. 4,870,706 issued on Oct. 3, 1989 to K. E. Ketcham et al. Separately-configured, air-inflatable, multiple-chambered pads are positioned in multiple fabric compartments strategically located on a lightweight fabric garment covering an athlete's upper body. Each of the multiple chambered pads is independent and can be removed from its matching compartment for replacement or repair.

Shock absorbing body protective pads for use by athletes in contact sports is described in U.S. Pat. No. 4,991,230 issued on Feb. 12, 1991 to E. J. Vacanti. The shock absorbing body protective pads comprise a pair of heat sealable woven scrim-reinforced plastic film members sealed together to form a plurality of cooperating and interconnected chamber elements. Each chamber element contains a foam pad constrainably retained within the chamber with the interior volume of at least two of the chamber elements being interconnected. A plurality of rigid tubular exhaust ports are arranged to communicate between the chambers and the ambient with the exhaust ports being disposed along the lateral edges of certain of the chambers and with these exhaust ports being arranged in an oppositely disposed relationship, one to another, so as to ensure continued communication with the ambient atmosphere.

U.S. Pat. No. 5,546,602 issued on Aug. 20, 1996 to R. D. Hale describes a garment that is worn during game play that provides protection against impact forces. The garment comprises inner and outer layers of a fabric mesh with an intermediate support layer. The support layer includes a primary air channel extending along the normal seam locations of the garment with an interwoven grid of secondary air tubes being in communication with the primary air channel. Pressurized air is introduced through a valve in the primary air channel so as to inflate the air channel and connected grids.

German Patent No. 4,229,328 A1 published in March, 1994 describes a shield that is part of protective clothing for motor cycle riders that has an under layer of shock-absorbent segments and a covering layer of a pliable material with wedged-shaped grooves between the segments. The free zones between the component parts are closed when the shrouding unit is curved into a fit. The shrouding is for the protection of vulnerable parts of the body, such as the shoulders, elbows, and knees.

None of the above inventions and patents, taken either singularly or in combination, is seen to describe the instant invention as claimed. Although the prior art is replete with protective gear to prevent injuries or, at the least, minimize the severity of an injury in contact sports, the protective gear of the prior art has numerous shortcomings which include inadequate shock absorption and restricted mobility. There exists a genuine need for protective padding gear that overcomes the disadvantages of the prior art. The air cushioning device of the present invention solves the aforementioned problems of the prior art.

SUMMARY OF THE INVENTION

Accordingly, it is a principal object of the invention to provide an air cushioned protective padding device that readily and reliably absorbs the shock and force from high intensity collisions between the participants of a contact sport such as football, hockey, or soccer. The present invention provides an air cushioned protective pad comprising a single piece of air filled rubber padding, which, when donned, forms creases that transforms the protective padding into a series of interconnected rubber cells or modules. The cells can have a variety of shapes depending upon the contour of the portion of the body being covered. However, in a preferred embodiment, the protective padding is designed to cover the shoulder, clavicular, and scapular areas, and the majority of the rubber cells have a hexagonal shape.

It is another object of the invention to provide an air cushioned protective device that can withstand repeated, multiple, and sudden impacts without becoming damaged, without rupturing or without deterioration of its structural integrity.

It is a further object of the invention to provide an air cushioned protective device that is designed to absorb a wide range of energy or impact loading.

Still another object of the invention is to provide an air cushioned protective device that is lightweight, comfortable, and that does not restrict movement.

It is an object of the invention to provide improved elements and arrangements thereof in an air cushioned protective device for the purposes described which is inexpensive, dependable and fully effective in accomplishing its intended purposes.

The modular configuration of the present invention is caused by the air cushioned protective padding conforming to the shape of the body area or areas covered at creases. These creases constitute flexible joints that allow the protective padding to conform to the shape of the body area being protected. For example, the protective padding of the present invention designed to be worn under football or hockey shoulder pads extends laterally conforming to the shape of the shoulders and extends anteriorly over the upper portion of the thorax conforming to the shape of the chest and extends posteriorly over the upper portion of the back conforming to the shape of the shoulder blades.

The protective padding of the present invention uses the cushioning power of air (i.e. compressibility characteristics) to absorb the shock from a blow to the shoulder, clavicular, and scapular areas. The protective padding slips over the head using a centrally disposed aperture with the protective padding surrounding the shoulders and covering the aforementioned areas. The innovative body contoured configuration of the present invention makes it possible for the protective padding of the present invention to effectively and efficiently absorb a broad spectrum of energy or impact loads ranging from low impacts to medium impacts to high impacts. The compressibility of air makes it an excellent shock absorber and with the innovative cell forming capability of the present invention, the rubber cells with their differing air pressures strategically cover and protect specific regions of the body according to their particular impact absorbing needs.

The flexible form-fitting design and the ability of the air-cushioned protective padding to form a pattern of rubber air filled cells allows intricate control and regulation of the shock absorbing ability of the entire protective pad and of selected regions of the pad. The innovative body contouring design of the protective padding endows the present invention with numerous advantages over the prior art which include excellent shock and impact force absorbing characteristics, finely tunable energy absorbing capabilities, air cushioned padding that readily conforms to shape of the body area covered, a wide range of energy or impact loading, and a high degree of protection and comfort.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
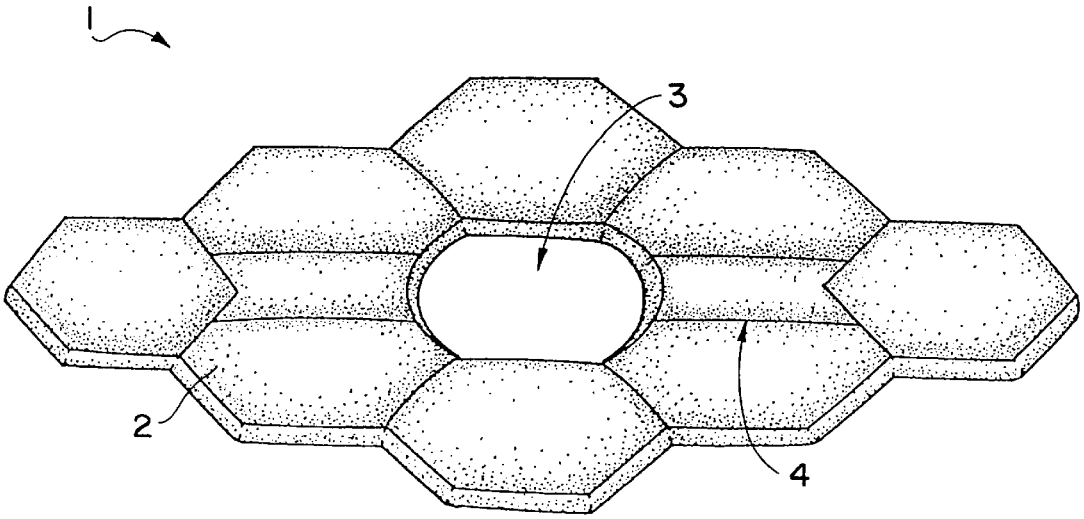
FIG. 1 is a perspective view of the air cushioning protective gear according to the present invention for use in contact sports.

FIG. 1 shows a perspective view of the air cushioned protective padding 1 of the present invention. The air cushioned protective padding 1 of the present invention is smooth with an oblong shape, an even surface, and inflated to a uniform air pressure. The air cushioned protective padding 1 of the present invention is pre-inflated with air and forms a unitary, sealed, rubber protective pad having about a ⅛ inch thickness.

However, when the air cushioned protective padding 1 is donned by a wearer 11, the protective padding 1 conforms to the shape of the body area or areas covered by forming creases 4 that divide the protective padding 1 into modules of varying air pressures. Thus, after being donned, the respective air pressures of the individual rubber cells or modules 2 are no longer uniform, even though the padding was initially inflated to a uniform air pressure at rest. FIG. 1 depicts the modular configuration that the rubber padding 1 takes on after the padding 1 has been slipped over the head 12 of a wearer 11 through a centrally disposed opening 3 and onto the wearer's shoulders.

Figure 2:
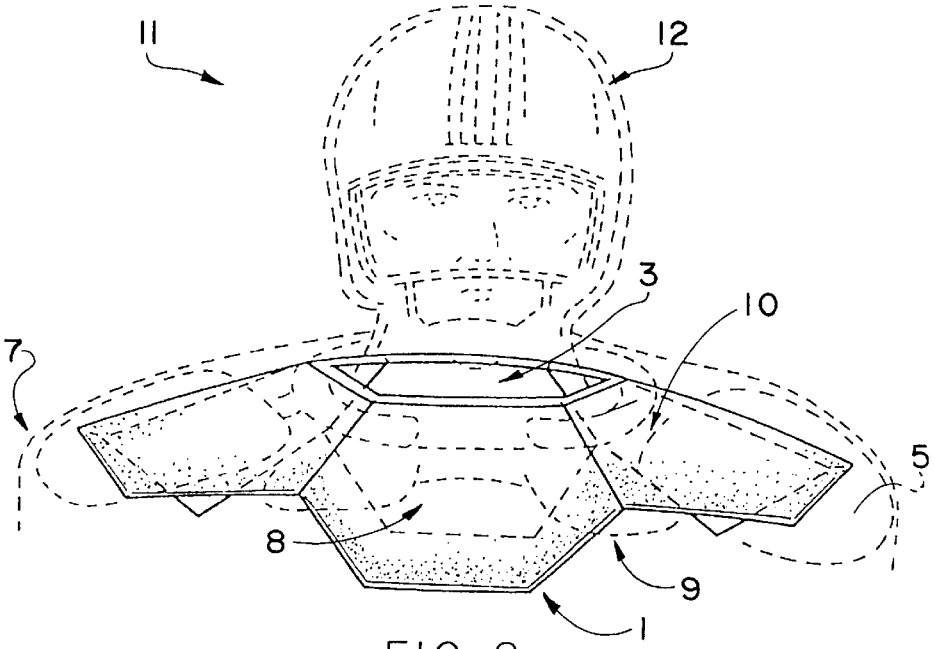
FIG. 2 is an environmental, front view of the air cushioning protective gear according to the present invention being worn underneath the shoulder pads of a football player.

This variation in the air pressure of the individual cells 2 of the protective padding 1 occurs as the air cushioned pad 1 is divided by the body contour along creases 4 into modules 2 having different air pressures. This donned modularity of the otherwise smooth, even, rubber protective padding 1 occurs because the parts or areas of the body have different impact load requirements and certain areas of the body require more freedom of movement than do other areas of the body. For example, for air cushioned protective padding 1 that covers the shoulder 7, clavicular 8, and scapular 9 areas as depicted in FIG. 2, greater impact loading occurs in the clavicular area 8 than in the shoulder and scapular areas (7,9) which requires that the rubber cells covering and protecting the clavicular area 8 have a higher air pressure than the cells protecting the shoulder and scapular areas (7,9). The shoulder area 7 also requires essentially unrestricted movement, therefore the rubber cells 2 protecting the shoulder area 7 have a lower air pressure, and consequently, a "looser" feel. The medial portion 10 of the shoulder area 7 has a high impact load requirement and therefore, the rubber cells 2 protecting that specific area 10 have a higher air pressure.

These variations in module air pressure are caused by the area covered; for example, a rigid area that requires high impact absorbance forcefully pushes the cushioning air inside a module outward towards the point of impact, whereas, a flexible or fleshy area that requires lower impact absorbance pushes the cushioning air outward less forcefully. The differential in air pressure among the rubber cells 2 endows the air cushioned protective padding 1 of the present invention with the ability to give rigid areas the greater shock absorbency that they need, whereas the more flexible areas receive less.

FIG. 2 shows an environmental, front view of the air cushioned protective padding 1 of the present invention with a football player 11 with helmet 12 and shoulder pads 5 in phantom. The air cushioned pad 1 is disposed directly beneath the shoulder pads 5 and rests upon the shoulder, clavicular, and scapular areas of the wearer 11. The rubber padding 1 has taken on a modular configuration underneath the shoulder pads 5 as clearly depicted in FIG. 2 which serves to increase the impact absorbing ability of the pad 1. The protective padding 1 is lightweight and not restrictive, an extremely important features because many athletes will not wear protective padding, no matter how beneficial, if the protective padding is excessively heavy and restrictive of the wearer's mobility. The air cushioned protective padding 1 of the present invention can absorb the shock and dissipate the impact energy created by a single impact, multiple impacts, and/or sudden impacts. The air cushioned padding 1 is so effective in absorbing and dissipating impact forces that players previously injured are able to play using the protective padding 1 without incurring further injury to the injured area of the body, or further aggravating the injured area.

Figure 3:
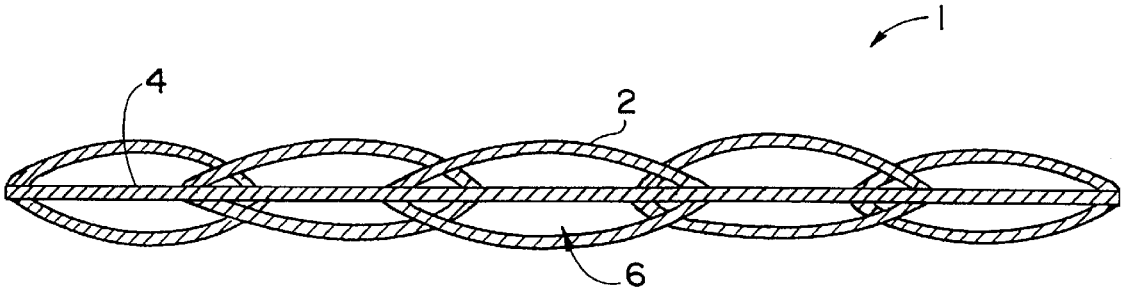
FIG. 3 is a cross-sectional view showing the air filled pockets of the air cushioning protective gear according to the present invention.

FIG. 3 depicts a cross-sectional view of the air cushioned padding 1 having an exoskeletal lattice-like structure, demonstrating a cross-section of the air filled pockets or modules 2. The exoskeletal lattice-like structure of the pad 1 conforms to the shape of the covered body area, wherein the pockets 2 have cavities 6 that fill with shock absorbing air. This modular conformation significantly increases the impact energy absorbency of the protective pad 1 by concentrating the shock absorbing power of the compressed air where it is needed the most. This increased shock absorbency is needed because the magnitude, duration, and frequency of impacts vary greatly during the course of a game. Furthermore, the air pockets 2 of the shape conformed air cushioned padding 1 ensures that the forces of an impact are properly distributed and dissipated along the air cushioned pad 1.

Figure 4:
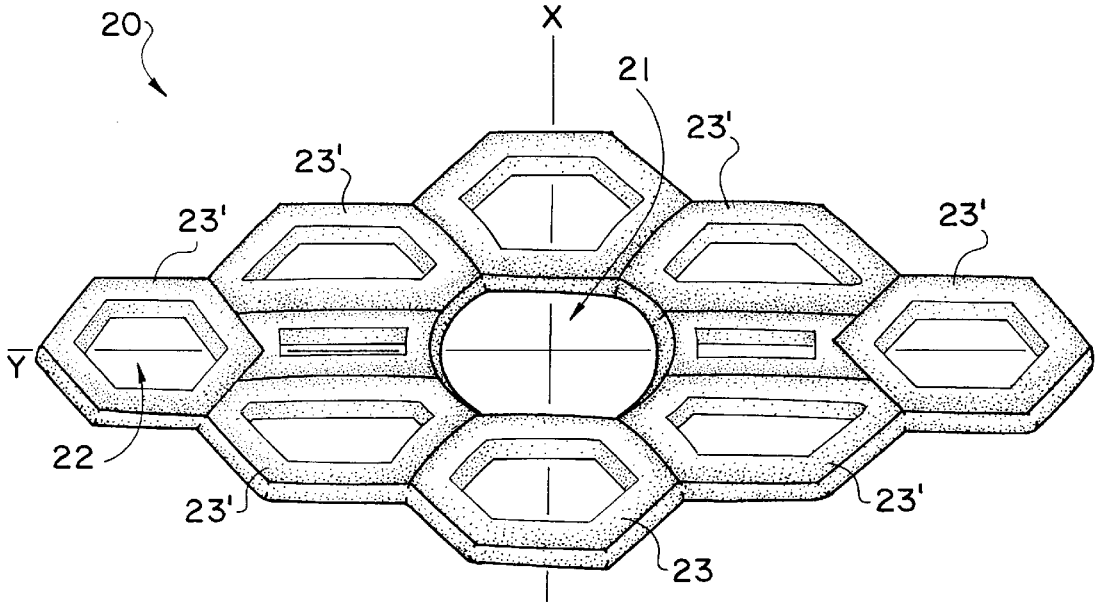
FIG. 4 is a perspective view of a preferred embodiment of the air cushioning protective gear according to the present invention showing symmetrically disposed openings.
Figure 5:
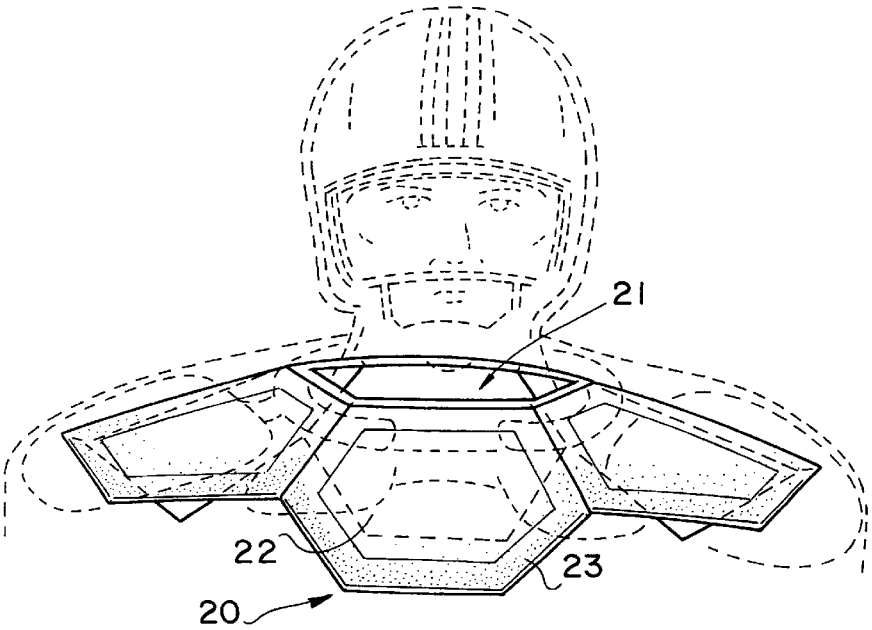
FIG. 5 is an environmental, front view of the preferred embodiment of the air cushioning protective gear according to the present invention being worn underneath the shoulder pads of a football player.
Figure 6:
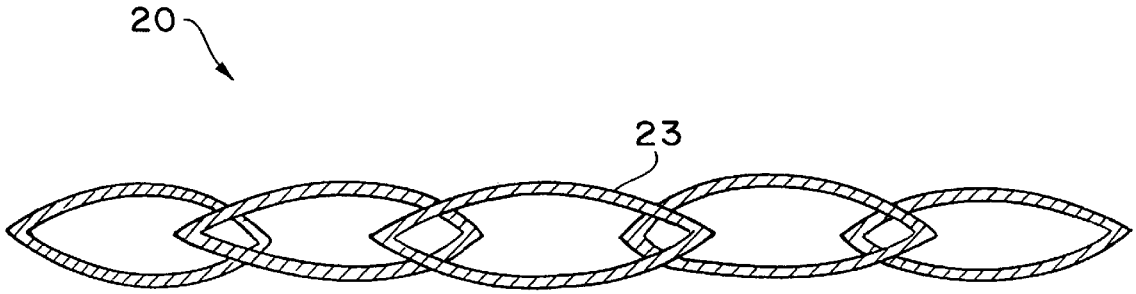
FIG. 6 is a cross-sectional view showing the air inflated sealed rubber lattice of the preferred embodiment of the air cushioning protective gear according to the present invention.

In a preferred embodiment depicted in FIG. 4, the air cushioned protective pad 20 has openings 22 that gives the undonned protective pad 20 a honeycomb appearance. These openings 22 form air filled pockets when the protective pad 20 is donned as depicted in FIG. 5 and the inflated sealed rubber lattice 23 forms a durable and flexible shock absorbing exoskeleton. The lattice or exoskeleton 23 being defined by a plurality of interconnected inflatable members 23'. The inflated sealed rubber lattice or exoskeleton 23 provides high impact protection, while maintaining the structural integrity of the air filled cavities 22 of the protective pad 20. When donned, the protective pad 20 has symmetry about two axes that are perpendicular to each other. One axis is a ventral-dorsal axis (X-axis) that extends from the chest area to the back area, while the second axis (Y-axis) is a lateral axis that extends from one shoulder to the other. This double symmetry ensures a uniform impact protection distribution to the corresponding respective parts of the body covered by the protective pad 20. The combination of the pliable air cushioned exoskeleton 23 and the air filled pockets 22 endow the protective pad 20 of the present invention with superior shock absorbing ability. The number and the size of the openings 22 can be varied to accommodate the specific shock absorbing requirements of the area of the body covered by the protective pad 20.

The present invention provides an air cushioned protective pad that is preferably smooth, generally oblong in shape and about ⅛ inch thick when inflated. However, when worn, the air cushioned pad takes on a modular configuration that results from the formation of creases and modules as the protective padding conforms to the shape of the covered area. This modular conformation dramatically increases the energy or impact loading capability of the protective pad. The protective padding of the present invention not only prevents injuries, but protects injured players from further injury making it possible for the injured player to continuing playing. The light weight design of the present invention ensures it use because athletes get the protection against injury they need, without sacrificing speed and/or mobility.

The air cushioned protective padding of the present invention can be used by players of any size, for example, by children playing little league football or hockey, by high school and college athletes, and by professional football or hockey players. The sealed rubber padding can be inflated to any appropriate uniform air pressure. The air input valve can be located anywhere near the neck opening and the air input valve is similar in appearance to those on basketballs or footballs. The shock absorbency of the air cushioned padding increases with increasing air pressure. The array of creases in the modular conformation of the air cushioned padding constitute flexible joints that allow the modules to easily and readily move relative to one another.

The air cushioned protective padding of the present invention not only protects the clavicle, the shoulder joint, and the scapula areas from collisions with other players, but also from collisions or extreme contact with the playing field or ice. It is this type of extreme contact with the playing field or ice that produces the dislocations, separations, fractures, and ligament and tendon damage associated with contact sports.

Smaller versions of the air cushioned protective padding of the present invention may be worn on the hip, thigh, and knee areas. These smaller versions would be appropriately shaped to fit under a hip pad, a thigh pad, or a knee pad and may or may not have a modular conformation when donned. Whether or not the air cushioned protective padding of the present invention remains smooth or takes on a modular conformation is determined by the contour of the body area covered by the padding.

The preferred embodiments of the present invention disclosed herein are intended to be illustrative only and are not intended to limit the scope of the invention. It should be understood by those skilled in the art that various modifications and adaptations of the present invention as well as alternative embodiments of the present invention may be contemplated. It is to be understood that the present invention is not limited to the embodiments described above, but encompasses any and all embodiments within the scope of the following claims.

I claim:

1. A protective padding for donning about the neck and shoulders of a person comprising:

a substantially oblong shaped unitary pad having a centrally disposed aperture adapted for receiving a neck of a person therein, said pad including an array of interconnected inflatable members symmetrically disposed about said central aperture, each of said members defining an centrally disposed opening;

said pad being sealed and inflated with an inflation medium to form an internal fluid filled space and said members being inflated to a uniform pressure when said pad is undonned;

said pad has a smooth surface when inflated to said uniform pressure, such that said smooth surface forms a flexible modular exoskeleton when said pad is donned; about the neck and shoulders of a person.

2. The protective padding according to claim 1, wherein:

said pad is made of rubber.

3. The protective padding according to claim 1, wherein:

said inflation medium is air.

4. The protective padding according to claim 1, wherein:

said pad is pliable.

5. The protective padding according to claim 1, wherein:

said pad has a double symmetry about two axes perpendicular to each other.

6. An air cushioning device for use in sports adapted to be donned about the neck and shoulders of a sportsman comprising:

an inflatable oblong shaped unitary sealed rubber pad having a centrally disposed aperture adapted for receiving a neck of a person therein, said pad including an array of interconnected members symmetrically disposed about said central aperture, each of said members defining an centrally disposed opening;

said sealed rubber pad being inflatable with air to a uniform pressure;

said sealed rubber pad having a double symmetry about two axes perpendicular to each other and a thickness of about ⅛ inch;

said sealed rubber pad having a smooth surface that forms a flexible modular exoskeleton when said sealed rubber pad is donned about the neck and shoulders of a person.

7. The air cushioning device for use in sports according to claim 6, wherein:

said inflated sealed rubber pad is pliable.

8. The air cushioning device for use in sports according to claim 6, wherein:

said inflated sealed rubber pad having symmetry about a ventral-dorsal axis and a lateral axis.

* * * * *